US006325530B1

(12) United States Patent
Bernazzani et al.

(10) Patent No.: US 6,325,530 B1
(45) Date of Patent: Dec. 4, 2001

(54) MIXED SIGNALING DEVICE FOR ROOMS WITH MESOPIC LIGHTING

(75) Inventors: Marie-Rose Bernazzani, Fontenay sous Bois; Jean-Claude Coeur, Chalon sur Saone, both of (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/625,537

(22) Filed: Jul. 26, 2000

(30) Foreign Application Priority Data

Aug. 18, 1999 (FR) ..... 99 10683

(51) Int. Cl.[7] ..... F21V 7/04

(52) U.S. Cl. ..... 362/555; 362/559; 362/812; 40/579

(58) Field of Search ..... 362/551, 559, 362/33, 97, 812, 555; 40/541, 579, 580, 570, 564

(56) References Cited

U.S. PATENT DOCUMENTS 4,969,068 * 11/1990 Williams ..... 362/99
5,105,568 4/1992 Branning ..... 40/570
5,365,411 11/1994 Rycroft et al. ..... 362/20
5,584,555 * 12/1996 Larsson ..... 362/23
5,921,012 * 7/1999 Caivano ..... 40/541

FOREIGN PATENT DOCUMENTS 41 09 532 A1 10/1991 (DE) ..... B44F/1/04
1 585 392 3/1981 (GB) ..... C09F/13/22

* cited by examiner

*Primary Examiner*—Sandra O'Shea
*Assistant Examiner*—John Anthony Ward
(74) *Attorney, Agent, or Firm*—Susan L. Parulski

(57) ABSTRACT

The signaling device for rooms with mesopic lighting comprises: a light-tight fixing box that has a base and lateral walls practically perpendicular to the base; a light source located inside the box; and a light opaque information panel closing the upper part of the box and extending between the lateral walls. The information panel comprises a symbol which is presented in the form of slots whose width is between 0.5 mm and 1.5 mm to enable the light to escape from the box in diffuse form and whose luminance is between 0.02 cd/m$^2$ and 0.5 cd/m$^2$. Advantageously, the light source emits radiation centered on 590 nm.

5 Claims, 2 Drawing Sheets

MIXED SIGNALING DEVICE FOR ROOMS WITH MESOPIC LIGHTING

CROSS-REFERENCE TO RELATED APPLICATIONS

This invention claims priority of French Patent Application No. 9910683 filed Aug. 18, 1999, titled "Mixed Signaling Device For Rooms With Mesopic Lighting" by Marie-Rose Bernazzani, et al.

FIELD OF THE INVENTION

The invention relates to safety signaling and more particularly in rooms that have relatively low main specific lighting.

BACKGROUND OF THE INVENTION

It is well known that the manufacture of photographic products must be carried out in rooms with very low light. It often happens that the manufacturing and finishing operations for light sensitive photographic products take place in dark rooms in which the lighting is mesopic lighting. This is due to the fact that the light sensitive products are fogged with lighting that can be very low.

Safety regulations require employers to indicate the emergency exits to their personnel using permanent panels. In premises with mesopic lighting, it is necessary to illuminate such panels so that they can be seen.

U.S. Pat. No. 5,365,411 titled "Exit Signs With LED Illumination," Nov. 15, 1994, by Rycroft et al., and U.S. Pat. No. 5,105,568 titled "Illuminated Sign Having Stencil Panel And Reflector Panel," Apr. 21, 1992, by Branning describe signaling panels comprising a box surrounding a light source and a screen bearing the information to be displayed and having light transparent zones and arranged in front of the source so that the luminous information can be seen by an observer. In U.S. Pat. No. 5,105,568 the sources are arranged to surround the transparent zones. In U.S. Pat. No. 5,365,411 the sources are arranged on the edges of the box and the light is reflected and diffused to illuminate the information panel uniformly.

It is an object of the invention to produce a signaling device that can be used in a room with mesopic lighting to limit to the minimum the interference light caused by the presence of the device in the room.

It is another object of the invention to enable the utilization of the same device when the room is exceptionally illuminated with photopic light.

SUMMARY OF THE INVENTION

This object is achieved by means of a signaling device for rooms with mesopic lighting, comprising a light-tight box having a base, side walls practically perpendicular to the base, an upper part of the box extending between the side walls forming a light-opaque information panel, and a light source inside the box. The device is characterized in that the information panel comprises a symbol, which is in the form of slots whose width is between 0.5 mm and 1.5 mm to allow the light to escape from the box in diffused form, and whose luminance is between 0.02 cd/m$^2$ and 0.5 cd/m$^2$.

In one advantageous embodiment, the light source emits radiation whose spectral width is relatively narrow and centered on 590 nm.

In another particularly advantageous embodiment, the information panel comprises one main side facing outwards and presenting, in photopic light, a background having a first appearance, and zones that surround the slots, which mark out the symbols represented by the slots, and which presents a second appearance, different from the first, so that the symbols formed by the zones can be seen in photopic lighting.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

To facilitate understanding, identical reference numerals have been used, where possible, to designate identical elements that are common to the figures.

DETAILED DESCRIPTION OF THE INVENTION

Figure 1:
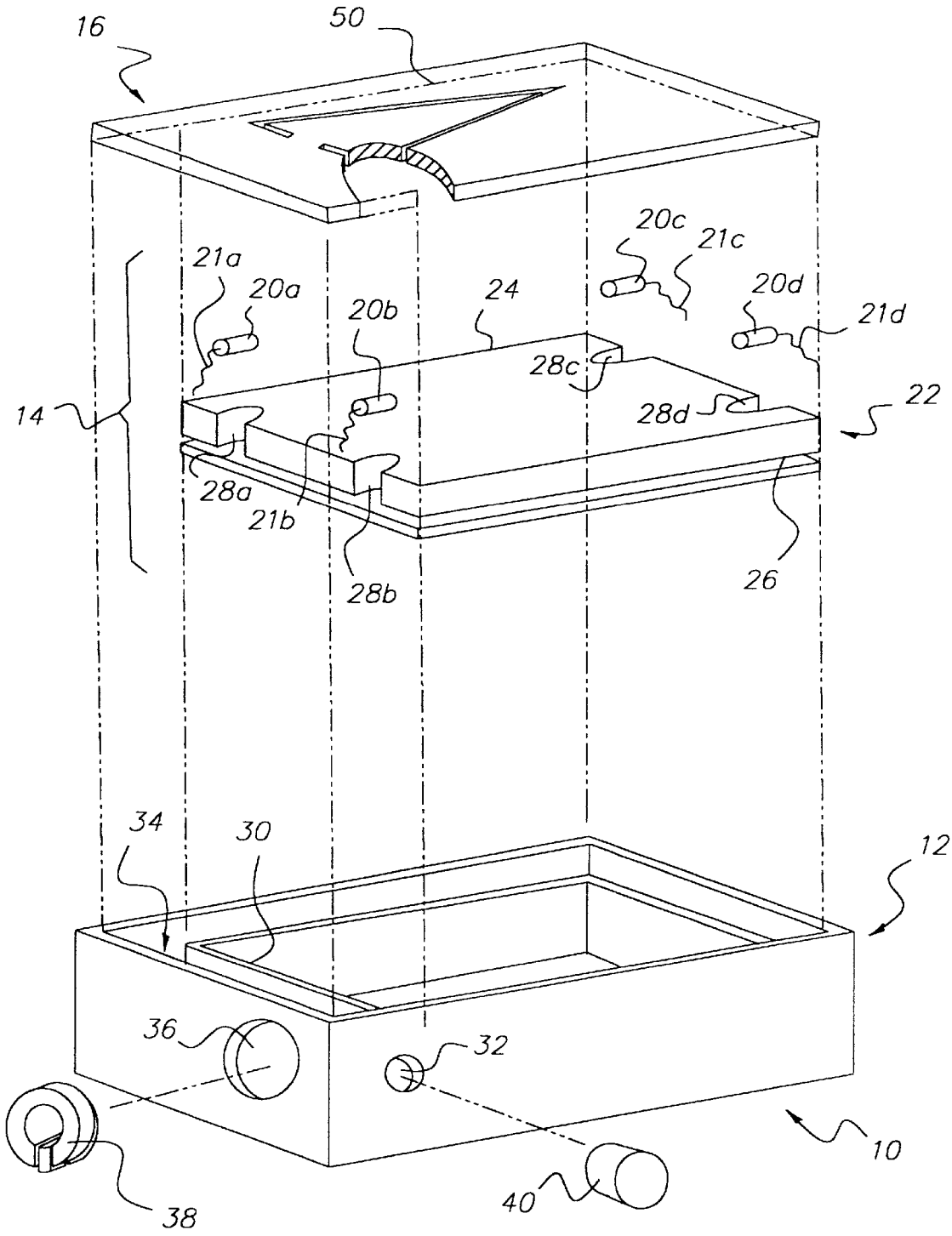
FIG. 1 represents diagrammatically an exploded view of the device according to the invention.

The following is a detailed description of the preferred embodiments of the invention, reference being made to the drawings in which the same reference numerals identify the same elements of structure in each of the several figures.

As can be seen, FIG. 1 represents an exploded view of a device 10 according to the invention. The device essentially comprises three parts: a box 12 containing a light source 14 closed by an information panel 16.

The box 12 is light-tight and has a base 17 and lateral walls 19 practically perpendicular to the base. It also comprises internal walls 30 whose utility will be explained below.

The information panel 16, which will be described in more detail below, closes the upper part of the box and enables legible information to be displayed such as a symbol or text, for example an "EMERGENCY EXIT" sign or others. In the embodiment shown, the information panel 16 presents a symbol in the form of an arrow.

Referring still to FIG. 1, the light source 14 comprises by four light-emitting diodes 20*a* to 20*d*, and a diffusing panel 22. The source for emitting light 14, preferably diffuse, is fixed in the box 12 for instance by screws on the walls 30 located inside the box. Advantageously, the diffusing panel 22 has a practically transparent element 24 in polycarbonate whose surface state is such that it produces diffusion phenomena at its surface. In one particularly advantageous embodiment, the surface of the main side of the polycarbonate element 24, which faces inwards to the box 12, is covered by a white reflector screen 26 so that the light is sent back towards the exterior of the box 12. In the embodiment represented, the light-emitting diodes 20*a*–20*d* are arranged on the section of the diffusing panel 22 inside spaces 28*a*–28*d* so that the maximum flux emitted by each light-emitting diode 20*a*–20*d* is sent inside the polycarbonate element 24. It can be advantageous to provide reflector elements on the surrounds to the polycarbonate element 24 to increase the efficiency of the diffusing panel 22. The other main side, facing towards the information panel 16 has a diffusing surface.

The light-emitting diodes 20*a*–20*d* are linked to an energy source (not shown) by electrical connectors 21*a* to 21*d*.

Advantageously, the electrical supply circuit (not shown and which can be arranged in a space 34 of the box) comprises an adjustable potentiometer which can be accessed by means of the aperture 32 in the box 12. Advantageously the aperture 32 will be fitted with a plug 40, for instance in rubber, to conserve the light-tightness. In one embodiment, the energy is supplied from an external source using an electrical connector (not shown) that penetrates into the box 12 through an aperture 36 fitted with a cable gland 38 to conserve the light-tightness.

The device, according to the invention, must prevent photographic products from fogging. Therefore, the illumination produced by the device 10 must be a minimum while enabling the displayed information to be "read." Thus light-emitting diodes 20*a*–20*d* will be utilized whose emission wavelength is centered on 590 nm. To enable the information to be seen in a solid angle as large as possible, the luminous information will be supplied through a relatively narrow slot 50 that enables the light to escape from the box 12 in diffuse form; the information panel 16 being made with light opaque material. In one particularly advantageous embodiment, the information carried by the information panel 16 is presented in the form of straight segments or lines because its interpretation is easier. On the embodiment of the information panel 16 represented in FIG. 1 and from which part has been removed to make it easier to understand the invention, only the slot 50 is shown. The width of the slot 50 is between approximately 0.5 mm and 1.5 mm. The luminance of the slot 50 will be adapted to the intended use according to the sensitivity of the photographic products and the distance separating the products from the source. It has been calculated that for employees working in a room with mesopic lighting approximately 5 m from the signaling panel, a source luminance of approximately 0.02 cd/m$^2$ would allow the symbol to be understood for a wavelength of 590 nm. It has been calculated that for another embodiment and in the same conditions, a source luminance of approximately 0.05 cd/m$^2$ would allow the symbol to be understood for a wavelength of 520 nm.

Figure 2:
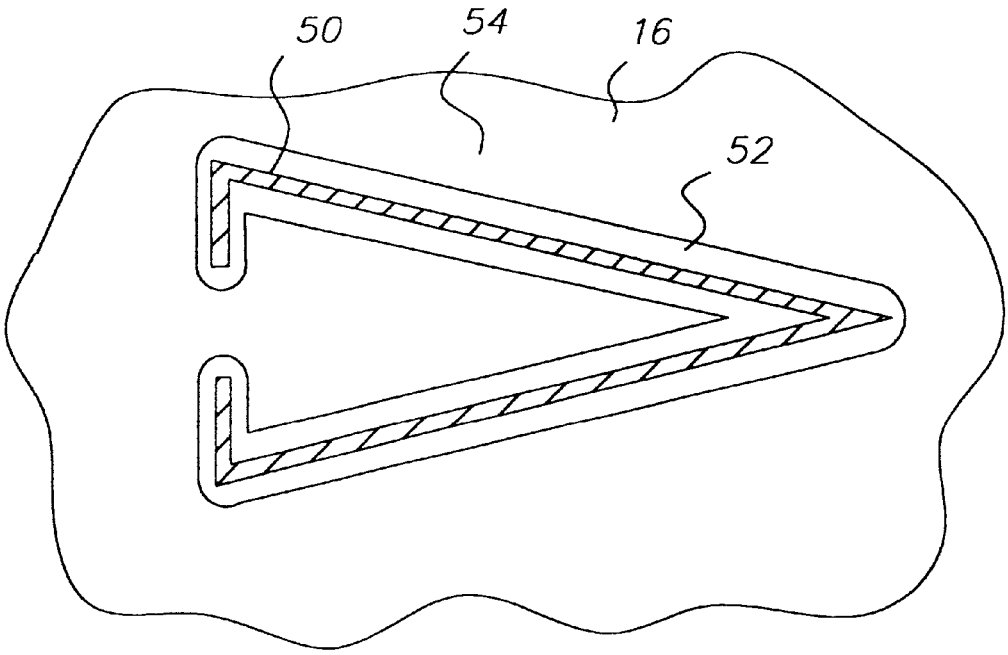
FIG. 2 represents another embodiment of an information panel bearing a symbol.

In another embodiment, represented in FIG. 2, the information panel 16 has been modified to enable the information to be seen when the room has photopic lighting, for example for maintenance purposes. In this embodiment, the visible side of the information panel 16, or background 54, presents, in photopic light, a first appearance. The slot 50 made in the information panel 16 and marking the symbol is surrounded by the zone 52 presenting, in photopic light, a second appearance distinct from the first and marking out the symbol. The contrast between the first appearance and the second appearance is enough to enable good legibility of the information represented. In the embodiment utilized, the information panel 16 is an engraving plate in plastic material having a thin layer, serving as a background, preferably green. The zone 52 was obtained by an engraving operation removing the green layer and exposing the white plastic material forming the information panel 16. The slot 50 was then made within the zone 52.

The invention has been described with reference to a preferred embodiment; However, it will be appreciated that variations and modifications can be effected by a person of ordinary skill in the art without departing from the scope of the invention.

| | |
|---|---|
| 10 | device |
| 12 | box |
| 14 | light source |
| 16 | information panel |
| 17 | base |
| 19 | lateral walls |
| 20a–20d | light-emitting diode |
| 21a–21d | electrical connector |
| 22 | diffusing panel |
| 24 | polycarbonate element |
| 26 | reflector screen |
| 28a–28d | space |
| 30 | internal walls |
| 32 | aperture |
| 34 | space of box 12 |
| 36 | aperture |
| 38 | cable gland |
| 40 | plug |
| 50 | slot |
| 52 | zone |
| 54 | visible side or background of information panel 16 |

What is claimed is:

1. A signaling device for rooms with mesopic lighting, comprising:

a light-tight box having a base, lateral walls practically perpendicular to the base and an upper part of the box extending between the lateral walls and forming a light opaque information panel;

a light source for emitting light inside the box; and characterized in that:

the information panel comprises a symbol that is presented in the form of slots having a width between 0.5 mm and 1.5 mm to enable the light to escape from the box in diffuse form, and a luminance between 0.02 cd/m$^2$ and 0.5 cd/m$^2$.

2. A device according to claim 1, wherein the light source comprises light-emitting diodes and a diffusing panel.

3. A device according to claim 2, wherein the diffusing panel presents a first main side facing inwards to the box and fitted with a screen reflecting the light, and a second main side facing outwards to the information panel and having a diffusing surface to send a practically uniform diffuse light to the information panel.

4. A device according to claim 3, wherein the light source emits radiation having a spectral width relatively narrow and centered on 590 nm.

5. A device according to claim 1, wherein the information panel comprises one main side facing outwards presenting, in photopic light, a background having a first appearance and zones surrounding the slots and marking out the symbols represented by the slots, the zones having a second appearance different from the first so that the symbols formed by the zones can be seen in photopic light.

* * * * *